United States Patent [19]

Morton

[11] Patent Number: 4,665,638

[45] Date of Patent: May 19, 1987

[54] QUILTING FRAME

[76] Inventor: Oscar E. Morton, R.R. #2, Box 33, Udall, Kans. 67146

[21] Appl. No.: 833,167

[22] Filed: Feb. 27, 1986

[51] Int. Cl.[4] ..... D05C 1/02; D06C 3/08

[52] U.S. Cl. ..... 38/102.1; 242/67.3 F; 248/172

[58] Field of Search ..... 38/102.1, 102, 102.4; 248/165, 172, 188.5; 242/67.3 F, 67.1 D

[56] References Cited

U.S. PATENT DOCUMENTS

| | | | |
|---|---|---|---|
| 672,809 | 4/1901 | Russell | 242/67.3 F |
| 1,237,974 | 8/1917 | Thomas | 242/67.3 F |
| 1,894,625 | 1/1933 | McCarthy | 38/102.1 X |
| 2,728,129 | 12/1955 | Koffman et al. | 38/102.1 X |
| 3,855,946 | 12/1974 | Bales | 248/188.5 X |

FOREIGN PATENT DOCUMENTS

| | | | |
|---|---|---|---|
| 14813 | 9/1911 | France | 242/67.3 F |

*Primary Examiner*—Werner H. Schroeder
*Assistant Examiner*—Andrew M. Falik

[57] ABSTRACT

A quilting frame is designed to stretch and hold material while hand stitching bed quilts. Primarily, it consists of a pair of legs that are adjustable in height and are free-standing when three rods for holding material are removed from the frame. A hand crank is provided for rotating the rods and a locking device is also employed for preventing rotation. Further tensioning is provided for by a horizontal tensioning mechanism pivotal on link rods attached to one of a pair of horizontal rods of the frame.

5 Claims, 6 Drawing Figures

FIG. 1
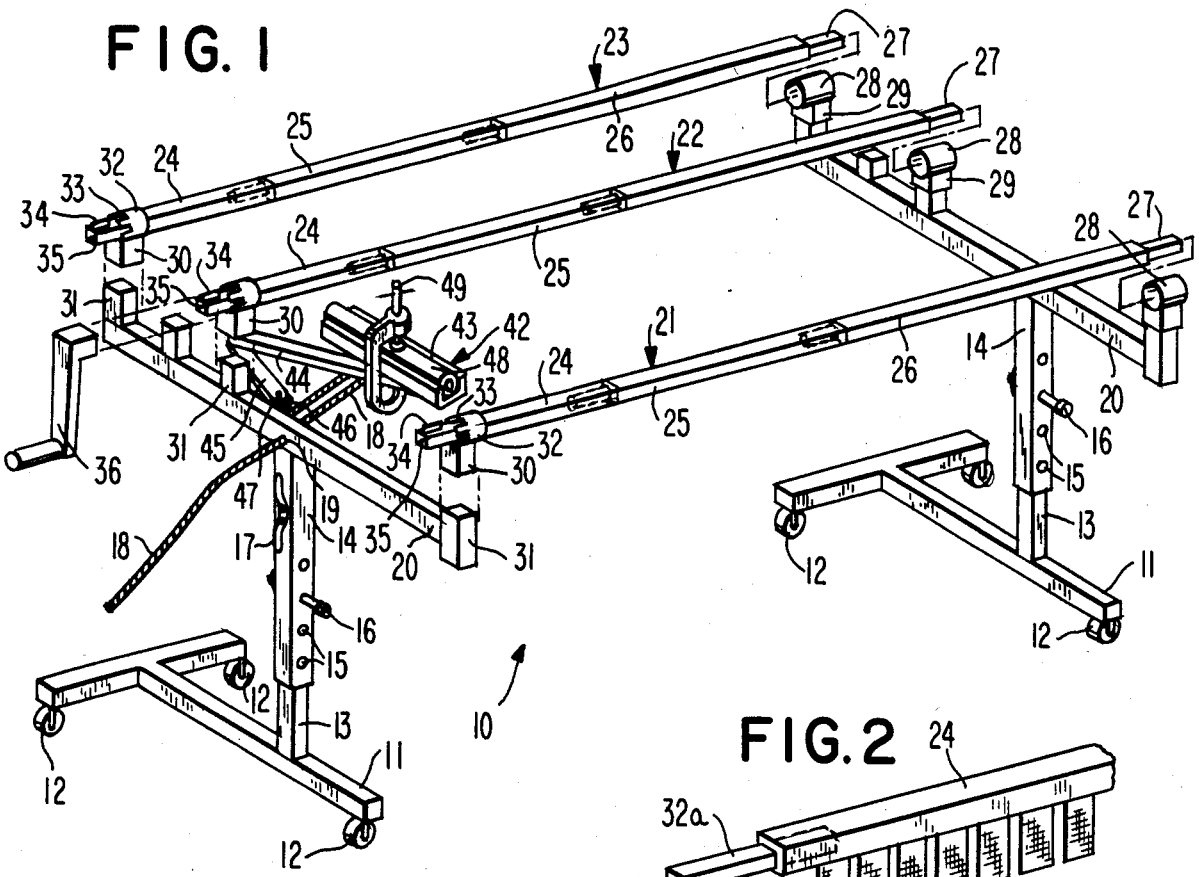
FIG. 2
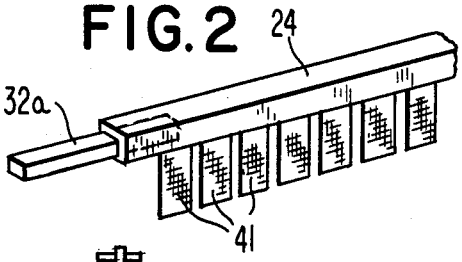
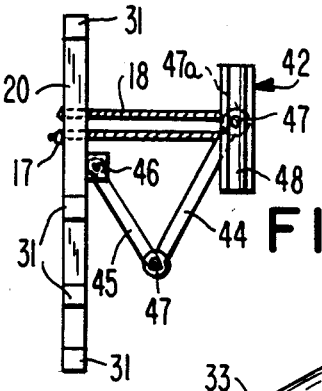
FIG. 3
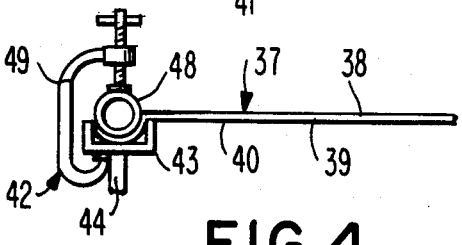
FIG. 4
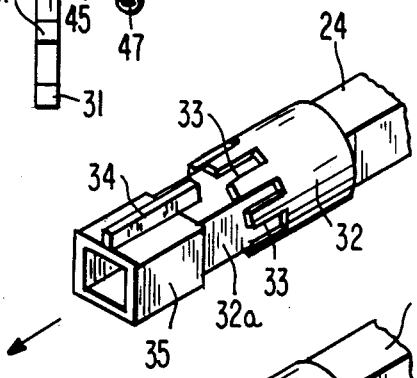
FIG. 5
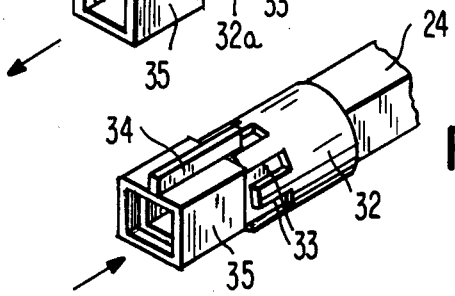
FIG. 6

QUILTING FRAME

BACKGROUND OF THE INVENTION

1. Field of the Invention

This invention relates to textile devices, and more particularly, to a quilting frame.

2. Description of Prior Art

References of record are the United States Pat. Nos. of Joseph Wetherill 23,631, John Angus et al 104,683, Joe Barron 599,092, and Sidney S. Russel 672,809. The frame in accordance with the present invention, will stretch and hold material while hand stitching bed quilts. Three layers of material are needed for a quilt and they are the quilt top, the batting, and the bottom, and this design is such, that a person can hand stitch a bed quilt more efficiently and quicker than was possible in the prior art.

For example, the reference of Russell teaches a quilting frame that folds compact. However, his structure has no provisions for applying tension on an unquilted top material and unquilted bottom material, that will be made more equal and constant.

The principal object of this invention is to provide a quilting frame, which will be of such design, as to stretch and hold the material while hand stitching a bed quilt, and the tension on the unquilted top and the unquilted bottom can be made more equal and constant.

Another object of this invention is to provide a quilting frame, which will have three rods that are fabricated in three sections that slip together for enabling a choice of four different working lengths, and the structure is elevatable as desired.

SUMMARY OF THE INVENTION

A quilting frame, comprising three rods fabricated in three sections that slip together for enabling a choice of four separate working lengths, and the structure is mobile and easily elevatable to a desired working height. Crank means and tensioning means are also provided for the efficient operation of the structure.

BRIEF DESCRIPTION OF THE DRAWINGS

FIG. 1 is a partially exploded perspective view of the present invention;

FIG. 2 is a fragmentary perspective view of one of the rails, showing webbing attached thereto;

FIG. 3 is a fragmentary top plan view of the stretching portion of the invention;

FIG. 4 is a fragmentary end elevational view, illustrating the method of securing the material, prior to stretching;

FIG. 5 is a fragmentary perspective view, illustrating the rod tension locking means, which is shown in the unlocked condition, and FIG. 6 is similar to FIG. 5, but illustrates the locked condition.

DETAILED DESCRIPTION

Accordingly, a quilting frame 10 is shown to include a pair of spaced "T"-shaped bases 11 having castors 12 thereon, for providing mobility for frame 10. The bottom of a leg 13 is suitably fixedly secured to the top of each base 11, and a sleeve 14 is telescopingly received on each leg 13, so as to provide elevation means for a suitable height of frame 10. A plurality of equally spaced openings 15 are provided transversely through legs 13 and sleeves 14, for the placement of a pin 16 or a bolt fastener if desired, so as to adjust the height of the sleeves 14. A cleat 17 is also suitably secured to a side of one sleeve 14, for the securement of a rope 18 which is freely received through an opening 19 transversely through one horizontal bar 20, for a purpose which will hereinafter be described. One horizontal bar 20 is suitably fixedly secured to the top of each sleeve 14, and a first bar 21, a second bar 22, and a third bar 23 are provided, and each include a first section 24, a second section 25, and a third section 26 which slip together for enabling a choice of three different working widths. The rear ends 27 of bars 21, 22, and 23, are removably received within bearing sleeves 28 that are suitably fixedly secured to upright portions 29 that are also fixedly secured to the rearmost horizontal bar 20. A vertical square sleeve 30 is fixedly secured to a forward portion of the first sections 24 of rods 21, 22, and 23, which will hereinafter be described and is removably received in upright portions 31 which are suitably fixedly secured to the top of the foremost horizontal bar 20.

For locking and unlocking crank means the forward portion includes, a sleeve 32 is secured fixedly to one end of square sleeve and a plurality of radially spaced cut-outs 33 are provided on one end of sleeves 32, for removably receiving a longitudinal rib 34 fixedly secured to the outer periphery of a square sleeve 35 which removably receives a crank handle 36, which is employed to rotate bars 21, 22, and 23. A bed quilt 37 to be hand stitched, consists of a top material 38, a batting material 39, and a bottom material 40, and webbing 41 is equally spaced and secured to each of the rods 21, 22, and 23, for enabling the materials 38, 39, and 40, to be fastened thereto, by pins or other means.

A tensioning mechanism 42 is provided and includes a "U"-shaped channel 43 secured at its center pivotally to a pair of pivotal and connecting link rods 44 and 45, which are also pivotal in bracket 46 by means of pivot pins 47. The rope 18 is suitably secured at one end, to the foremost or front bar 20 and is carried around a pulley **47*a* held to channel 43 by the pin 47 attaching channel 43 to the link rod 44. Tensioning mechanism 42 is so designed, as to stretch the materials 38, 39, and 40, end-wise, and 42 moves in a path parallel with the rods 21 and 22, while remaining perpendicular when applying tension. A pipe 48 is received in channel 43 on top of the material, and an adjustable clamp 49 is employed to clamp the material stationary between the channel 43 and the outer periphery of the pipe 48**.

In use, the unquilted bottom material 40 and the batting material 39 unrolls from rod 22 onto the first rod 21, and the top material 38 also unrolls from the rod 23 and the desired area of the quilt 37 is positioned between the first rod 21 and the second rod 22. The sleeves 35 are then urged inward, engaging the ribs of this locking arrangement in one of the cut-out openings 33 of the sleeves 32. To obtain the desired tension on the quilt 37, each rod 21, 22, and 23, may be rotated further by engaging the crank handle 36, prior to the above-mentioned locking procedure, thus, stretching the materials from front to back. To stretch the materials 38, 39, and 40, end-wise, the tensioning mechanism 42 is employed by compressing 38, 39, and 40, between the pipe 48 and the channel 43, through the employment of the clamp 42. The operator then pulls upon the rope 18, which pulls the material toward him, afterwhich, he then secures the rope 18 to the cleat 17 on sleeve 14.

It shall also be noted, that the sleeves 28 for rods 22 and 23, have three working positions for compensating for the difference in the size or diameter of the third rod 23, which has the additional thickness of the batting material 39 rolled on it with the bottom material 40, and each of the pair of legs 13 are free-standing with or without the rods, enabling the materials 38, 39, and 40, to be pinned to the webbing 41 and rolled to the approximate starting position while on a flat surface or the floor, prior to mounting in the elevated positions in frame 10.

While various changes may be made in the detail construction, such changes will be within the spirit and scope of the present invention, as defined by the appended claims.

What I now claim is:

1. A quilting frame, comprising, a pair of horizontal bars supported by leg means, and a first rod assembly, a second rod assembly, and a third rod assembly received on said pair of horizontal bars of said quilting frame wherein a quilt comprises a top material on top of a batting material and said batting material engages with a bottom material, and said first rod assembly, said second rod assembly, and said third rod assembly comprise three sections that fit one into the other and are separable for a choice of three separate working widths of said quilt, and one of said pair of horizontal bars is provided with three upright portions fixedly secured to the top of said one horizontal bar, and a bearing sleeve is fixedly secured to each of said three upright portions and removably receives a rear end of said first rod assembly, said second assembly, and said third rod assembly, for rotary support.

2. A quilting frame as set forth in claim 1, wherein a front end of said first rod assembly, said second rod assembly, and said third rod assembly, includes a toothed sleeve and one end of a square sleeve is fixedly secured to the outer periphery of said toothed sleeve, and the other end of said square sleeve is removably received on three other upright portions fixedly secured to the other of said pair of horizontal bars, and said front end of said first bar assembly, said second bar assembly, and said third bar assembly, are rotatably received in said toothed sleeve.

3. A quilting frame as set forth in claim 2, wherein said front end of each said bar assembly is square in cross-sectional configuration and is provided with a projecting longitudinal rib fixedly secured to the outer periphery of said toothed sleeve, and a hand crank is removably received on said front end of each said bar assembly, for rotating and tightening said quilt on said quilt frame, and said rib is entered between spaced teeth of said toothed sleeve to lock each said bar assembly against rotation.

4. A quilting frame as set forth in claim 3, wherein a tensioning mechanism is provided on said quilting frame and includes a channel secured at its center pivotally to a pair of pivotal and connecting link rods that are also pivotal in a bracket by pivot pins, and said bracket is fixedly secured to said other of said pair of horizontal bars, and a rope is secured at one end to said other of said pair of horizontal bars and is received around a pulley held to said channel by pin means, and said pin means also secures said channel to one of said link rods.

5. A quilting frame as set forth in claim 4, wherein a pipe is removably received in said channel on top of one end of said material and an adjustable clamp is provided and clamps said material stationary in said channel by engaging said pipe and said channel, and pulling on said rope to stretch said material, causes said channel to move towards said other of said pair of horizontal bars, and said rope when tensioning is completed, is tied to a cleat fixedly secured to said quilt frame.

* * * * *